US006871588B2

(12) United States Patent
Sasaki et al.

(10) Patent No.: US 6,871,588 B2
(45) Date of Patent: Mar. 29, 2005

(54) INK BOTTLE MOUNTING APPARATUS AND INK BOTTLE FOR THE APPARATUS

(75) Inventors: Kuninori Sasaki, Ibaraki-ken (JP); Takahiro Wakayama, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 129 days.

(21) Appl. No.: 09/957,509

(22) Filed: Sep. 21, 2001

(65) Prior Publication Data

US 2002/0035940 A1 Mar. 28, 2002

(30) Foreign Application Priority Data

Sep. 27, 2000 (JP) ..... P2000-293891
Jun. 20, 2001 (JP) ..... P2001-187074

(51) Int. Cl.[7] ..... B41L 13/18; G03G 15/08

(52) U.S. Cl. ..... 101/119; 220/669; 222/325; 399/262

(58) Field of Search ..... 101/119, 350.4, 101/364, 350.1; 347/86; 399/262; 215/382, 383, 395; 220/669, 671, 672; 222/325

(56) References Cited

U.S. PATENT DOCUMENTS 4,949,123 A * 8/1990 Takashima ..... 399/12
5,261,568 A * 11/1993 Corby et al. ..... 222/167
5,311,265 A * 5/1994 Miller ..... 399/106
5,455,662 A * 10/1995 Ichikawa et al. ..... 399/260
5,609,101 A * 3/1997 Oyama et al. ..... 101/116
5,678,121 A * 10/1997 Meetze et al. ..... 399/12
5,903,806 A * 5/1999 Matsuoka et al. ..... 399/258
6,097,903 A * 8/2000 Yahata et al. ..... 399/27

* cited by examiner

*Primary Examiner*—Stephen R. Funk
(74) *Attorney, Agent, or Firm*—Nath & Associates PLLC; Gary M. Nath; Gregory B. Kang

(57) ABSTRACT

An ink bottle mounting apparatus comprising a bottle mounting apparatus body 11 having an ink bottle 1 and a bottle insertion chamber 12 into which the ink bottle 1 is inserted, wherein the ink bottle mounting apparatus further comprises a bottle lock member 15 which is engaged with a groove 5 formed on a side peripheral surface of the ink bottle 1 to prevent the ink bottle 1 from being pulled out when the ink bottle 1 is mounted to the bottle mounting apparatus body.

15 Claims, 16 Drawing Sheets

INK BOTTLE MOUNTING APPARATUS AND INK BOTTLE FOR THE APPARATUS

BACKGROUND OF THE INVENTION

1. Field of the Invention

The present invention relates to an ink bottle apparatus to which an ink bottle is inserted and mounted, and an ink bottle mounted to the apparatus.

2. Description of the Related Art

For example, in a stencil printing machine that is one of related art printing machine, a stencil paper of stencil printing plate is wound around a drum based on image information, a print paper is moved while bringing the paper into contact with the rotating drum under pressure, and an ink image is directly transferred to the print paper, or a transfer body is rotated and moved while bringing the transfer body into contact with the rotating drum under pressure, the ink image is once transferred to the transfer body, the print paper is moved while bringing the print paper into contact with the rotating transfer body under pressure, and the ink image is transferred to the print paper. In such a stencil printing machine, an ink bottle mounting apparatus that is an ink supply source for supplying ink from an inner surface of the drum is provided.

FIG. 1 shows one example of this related ink bottle mounting apparatus 100. As shown in FIG. 1, the bottle mounting apparatus body 101 is provided with a bottle insertion chamber 103 into which an ink bottle 102 is inserted. An ink suction port (not shown) is disposed in a deepest position of the bottle insertion chamber 103. The bottle insertion chamber 103 is provided at its inlet side with a bottle lock member 104. The bottle lock member 104 can rotate between a bottle lock position that abuts against an insertion rear end surface 102*a* of the ink bottle 102 located at a mounting position and a lock releasing position that permits insertion and pulling out of the ink bottle 102. The bottle lock member 104 is biased toward the bottle lock position by a spring 105.

On the other hand, the ink bottle 102 is made of synthetic resin into substantially cylindrical shape. An ink discharge port 106 projects from an insertion leading end surface of the ink bottle 102. The ink bottle 102 is locked by the bottle lock member 104 in a mounting position of the bottle insertion chamber 103, so that connection between the ink discharge port 106 of the ink bottle 102 and the ink suction port (not shown) on the side of the bottle mounting apparatus body 101 is not easily separated from each other.

A replacing operation of the ink bottle 102 having the above-described structure will be explained. As shown in FIG. 2, an operator moves the bottle lock member 104 to the lock releasing position by one hand, and pulls out the ink bottle 102 in the bottle insertion chamber 103 from the chamber 103 with the other hand. As shown in FIG. 3, if the ink bottle 102 has been pulled out completely, the operator moves the bottle lock member 104 to the lock releasing position with one hand, and holds a new ink bottle 102 with the other hand. In a state in which the insertion leading end surface of the ink bottle 102 is aligned to a predetermined rotation position, the ink bottle 102 is aligned to the inlet position of the bottle insertion chamber 103. Then, as shown in FIG. 4, the ink bottle 102 is inserted to the mounting position of the bottle insertion chamber 103, and the one hand is released from the bottle lock member 104. Then, the bottle lock member 104 is rotated into the bottle lock position by a spring force of the spring 105, the insertion rear end surface of the ink bottle 102 is pushed to lock the ink bottle 102, and the replacing operation is completed.

In related ink bottle mounting apparatus 100, however, when the ink bottle 102 is replaced, the bottle lock member 104 must be operated with one hand, and both the inserting operation and pulling out operation of the ink bottle 102 must be done with the other hand. Thus, the operator must replace the ink bottle 102 using both hands, and there is a problem that the replacing operation is troublesome.

Further, the entire length of the ink bottle 102 is varied in some cases due to swelling caused by temperature variation of the ink. If the entire length of the ink bottle 102 is varied, a position of the insertion rear end surface of the ink bottle 102 in the mounting position is varied. As a result of such variation, there are problems that a locking force of the ink bottle 102 by the bottle lock member 104 is lowered or the locking force is excessively increased.

SUMMARY OF THE INVENTION

The present invention has been accomplished to solve the above problems, it is an object of the invention to provide an ink bottle mounting apparatus and an ink bottle used for the apparatus in which the ink bottle can be locked in its mounting position and the ink bottle can easily be replaced. It is another object of the invention to provide an ink bottle mounting apparatus and an ink bottle used for the apparatus in which the ink bottle can be locked in its mounting position, the ink bottle can easily be replaced, and the ink bottle can reliably be locked with a predetermined locking force even if the entire length of the ink bottle is varied due to swelling of the ink bottle or the like.

A first aspect of the invention provides an ink bottle mounting apparatus comprising a bottle mounting apparatus body having an ink bottle and a bottle insertion chamber into which the ink bottle is inserted, wherein the ink bottle mounting apparatus further comprises a bottle lock member which is engaged with a to-be locked portion formed on a side peripheral surface of the ink bottle to prevent the ink bottle from being pulled out when the ink bottle is mounted to the bottle mounting apparatus body.

Since this ink bottle mounting apparatus is automatically locked when the ink bottle is inserted, it is very easy to mount the ink bottle.

In the ink bottle mounting apparatus, the bottle lock member is provided at a position opposed to the to-be locked portion formed on the ink bottle mounted to the bottle insertion chamber, the bottle lock member can be displaced between a bottle lock position where the bottle lock member engages the to-be locked portion of the ink bottle located at a mounting position and a bottle moving permissible position where the ink bottle is allowed to move, and when the bottle lock member receives a constant or greater force from a bottle inserting/pulling out direction, the bottle lock member is displaced from the bottle lock position to the bottle moving permissible position by the force, and if the ink bottle is pulled out, the bottle lock member automatically returns to the bottle lock position.

In this ink bottle mounting apparatus, if a predetermined or greater pulling force is applied to pull out the ink bottle from the bottle insertion chamber, the bottle lock member receives a pulling force of the ink bottle and displaced from the bottle lock position to the bottle moving permissible position, the ink bottle is allowed to be pulled out, the ink bottle is pulled out from the bottle insertion chamber, if the ink bottle is inserted into the bottle insertion chamber, the bottle lock member abuts against the insertion leading end surface of the ink bottle, and if the ink bottle is further inserted from this state, the bottle lock member receives an inserting force of the ink bottle and displaced from the bottle lock position to the bottle moving permissible position, and the ink bottle is allowed to insert, and if the ink bottle is inserted up to the mounting position, the to-be lacked portion of the ink bottle and the bottle lock member are opposed so that the bottle lock member does not receive the inserting force, the bottle lock member is displaced toward the bottle lock position and the ink bottle is locked. When the ink bottle is to be inserted or pulled out, the ink bottle is simply inserted or pulled out with a predetermined or greater inserting force or pulling out force.

In the above-described ink bottle mounting apparatus, the bottle lock member engages the to-be locked portion located on an insertion leading end of the ink bottle.

In this ink bottle mounting apparatus, even if the entire length of the ink bottle is varied due to swelling of ink, a position of the to-be locked portion of the ink bottle located in the mounting position is not varied almost at all.

In the above-described ink bottle mounting apparatus, the bottle lock member may comprise a leaf spring.

In this ink bottle mounting apparatus, the bottle lock member can be displaced between the bottle lock position and the bottle moving permissible position by a spring force of the leaf spring only by disposing the leaf spring.

In the above-described ink bottle mounting apparatus, the bottle lock member is biased toward the bottle lock position by a spring force of spring.

In this ink bottle mounting apparatus, the bottle lock member is moved between the bottle lock position and the bottle moving permissible position by the spring force of spring.

In the above-described ink bottle mounting apparatus, the bottle lock member may be made of synthetic resin member that can be resiliently deformed.

In this ink bottle mounting apparatus, the bottle lock member can be displaced between the bottle lock position and the bottle moving permissible position by a resilient deformation of the leaf spring only by disposing the synthetic resin bottle lock member.

Further, in an ink bottle that can be mounted by inserting a bottle body into a bottle insertion chamber of a bottle mounting apparatus body of an ink bottle mounting apparatus, the bottle body comprises a to-be locked portion engaged with a bottle lock member of the bottle mounting apparatus body at the mounting position of the side peripheral surface of the bottle body.

In this ink bottle, since the ink bottle is automatically locked when the bottle body is inserted, the ink bottle can be mounted to the ink bottle mounting apparatus very easily.

In the above-described ink bottle, the to-be locked portion is provided on an insertion leading end of the bottle body.

In this ink bottle, even if the entire length of the ink bottle is varied due to swelling of ink, a position of the to-be locked portion of the ink bottle located in the mounting position is not varied almost at all.

In the above-described ink bottle, the to-be locked portion is a grooved that is recessed deeper than the side peripheral surface of the bottle body.

In this ink bottle, a groove that is originally utilized for drawing a mold of injection molding can be utilized.

In the above-described ink bottle, the to-be locked portion is a projection projecting higher than the side peripheral surface of the bottle body.

DETAILED DESCRIPTION OF THE PREFERRED EMBODIMENT

A mode for carrying out the invention will be explained based on the drawings below.

Figure 1:
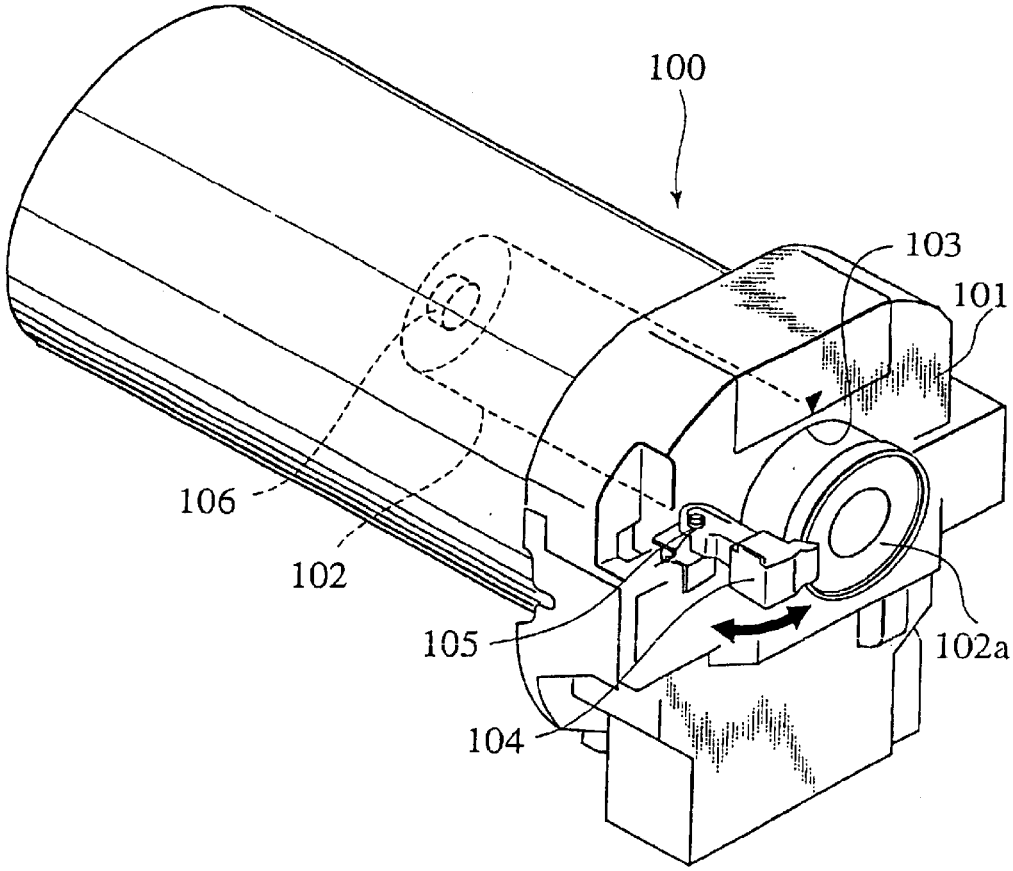
FIG.1 PRIOR ART
FIG. 1 is a perspective view of a bottle mounting apparatus to which an ink bottle is mounted in a related printing machine.
Figure 2:
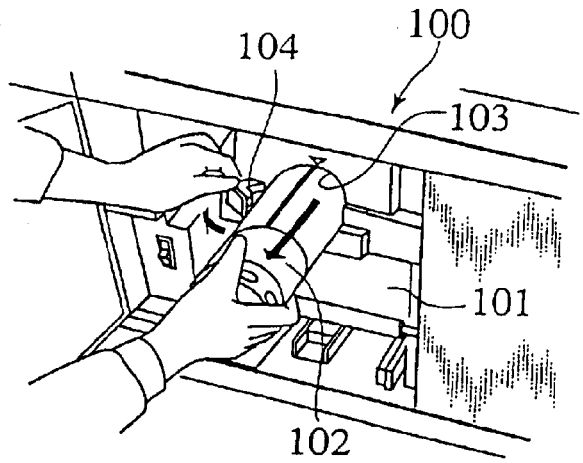
FIG.2 PRIOR ART
FIG. 2 is a perspective view showing a state in which the ink bottle is being pulled out from a bottle insertion chamber in the related printing machine.
Figure 3:
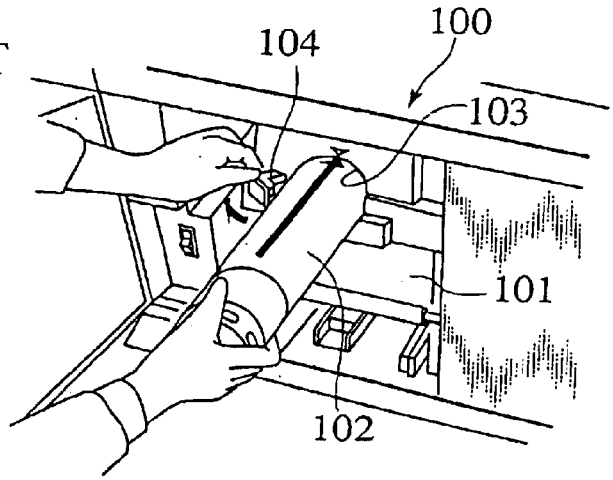
FIG.3 PRIOR ART
FIG. 3 is a perspective view showing an ink bottle insertion starting state into the bottle insertion chamber in the related printing machine.
Figure 4:
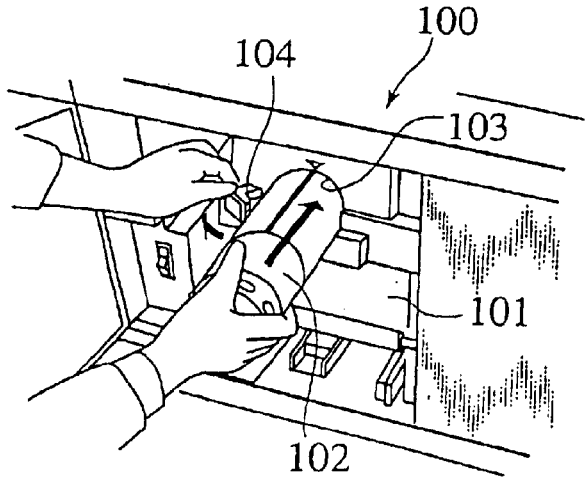
FIG.4 PRIOR ART
FIG. 4 is a perspective view showing an insertion state of the ink bottle into the bottle insertion chamber in the related printing machine.
Figure 5:
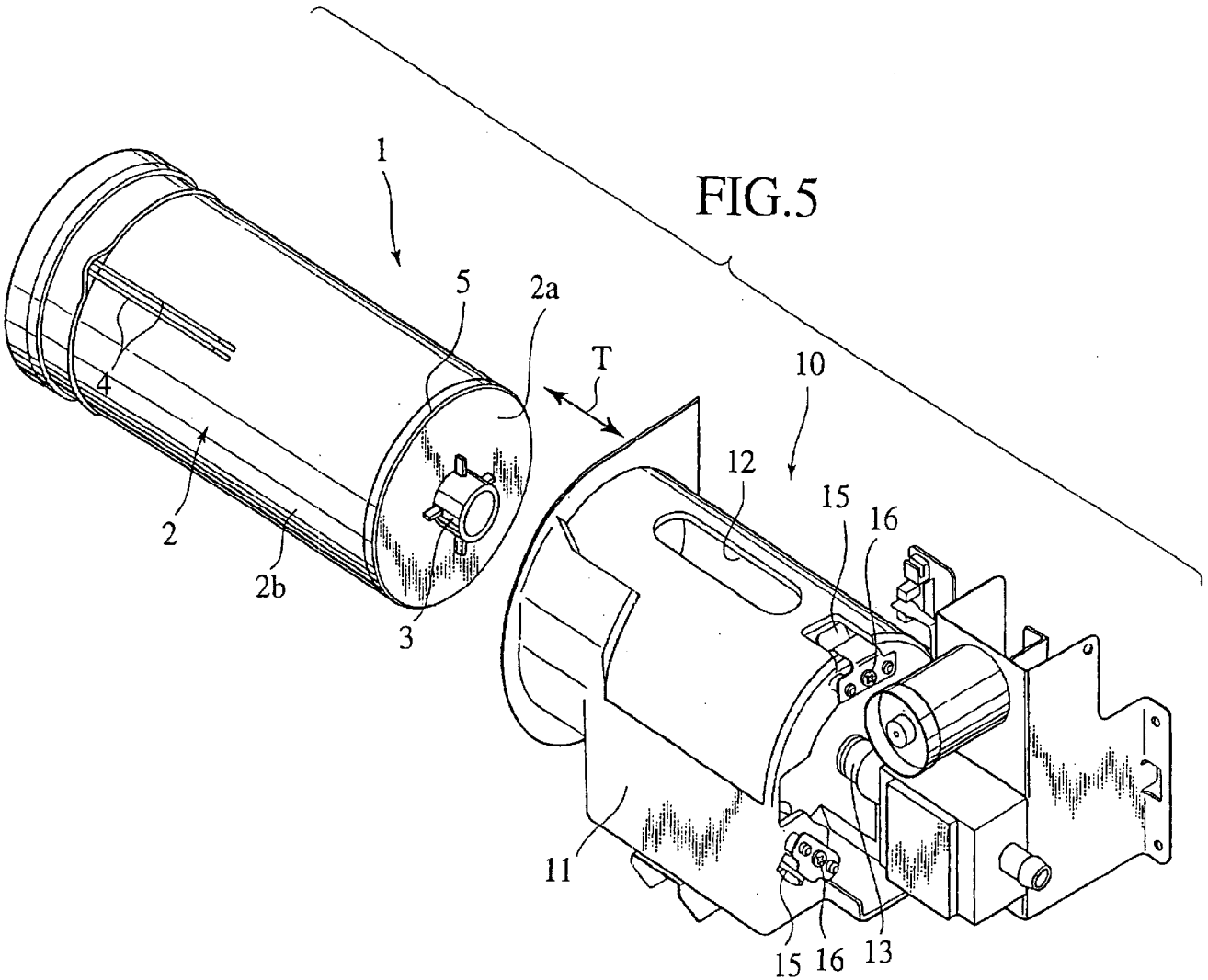
FIG. 5 shows a mode for carrying out the invention, and is a perspective view of an ink bottle mounting apparatus before the ink bottle is inserted.
Figure 6:
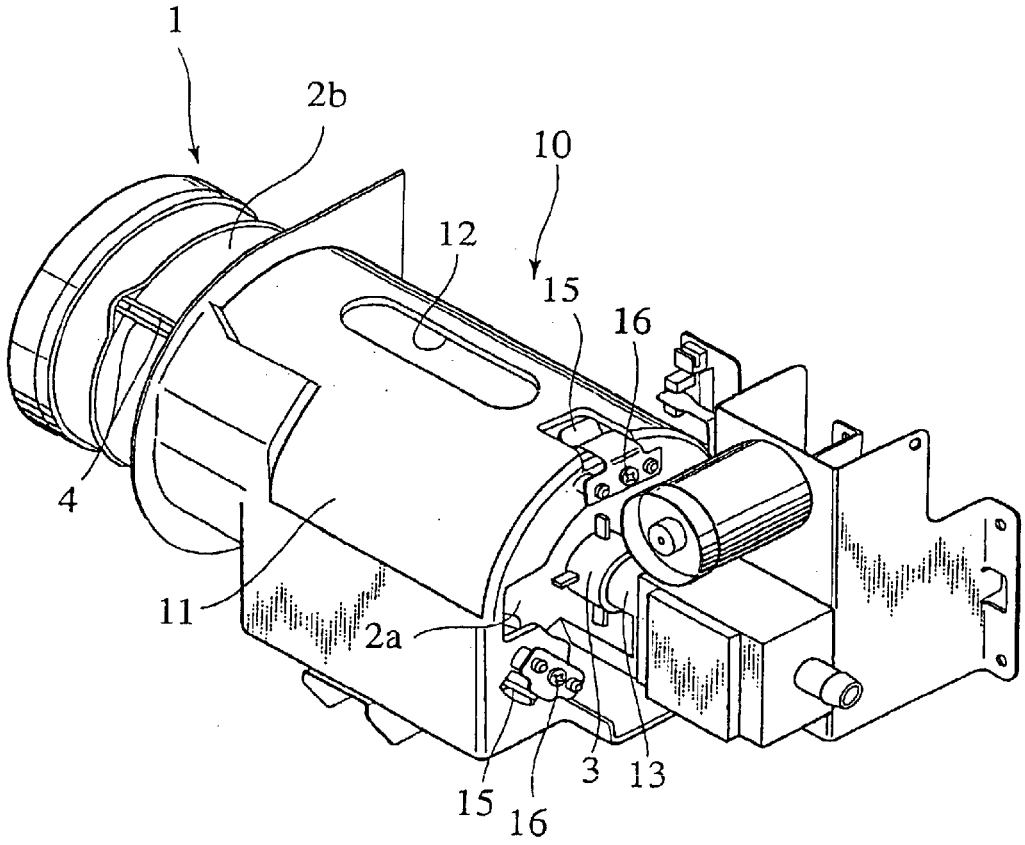
FIG. 6 shows a mode for carrying out the invention, and is a perspective view of an ink bottle mounting apparatus to which the ink bottle is mounted.
Figure 7:
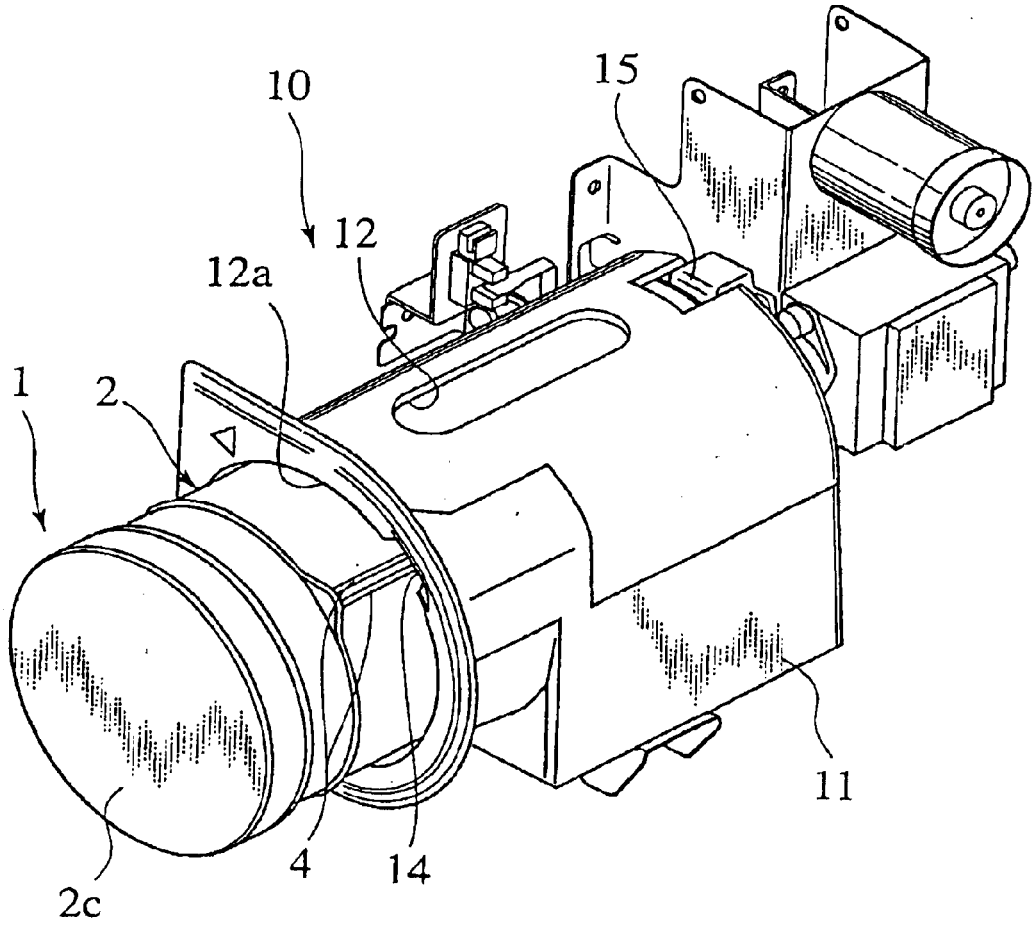
FIG. 7 shows the mode for carrying out the invention, and is a perspective view, from a direction different from FIG. 6, of the ink bottle mounting apparatus to which the ink bottle is mounted.
Figure 8:
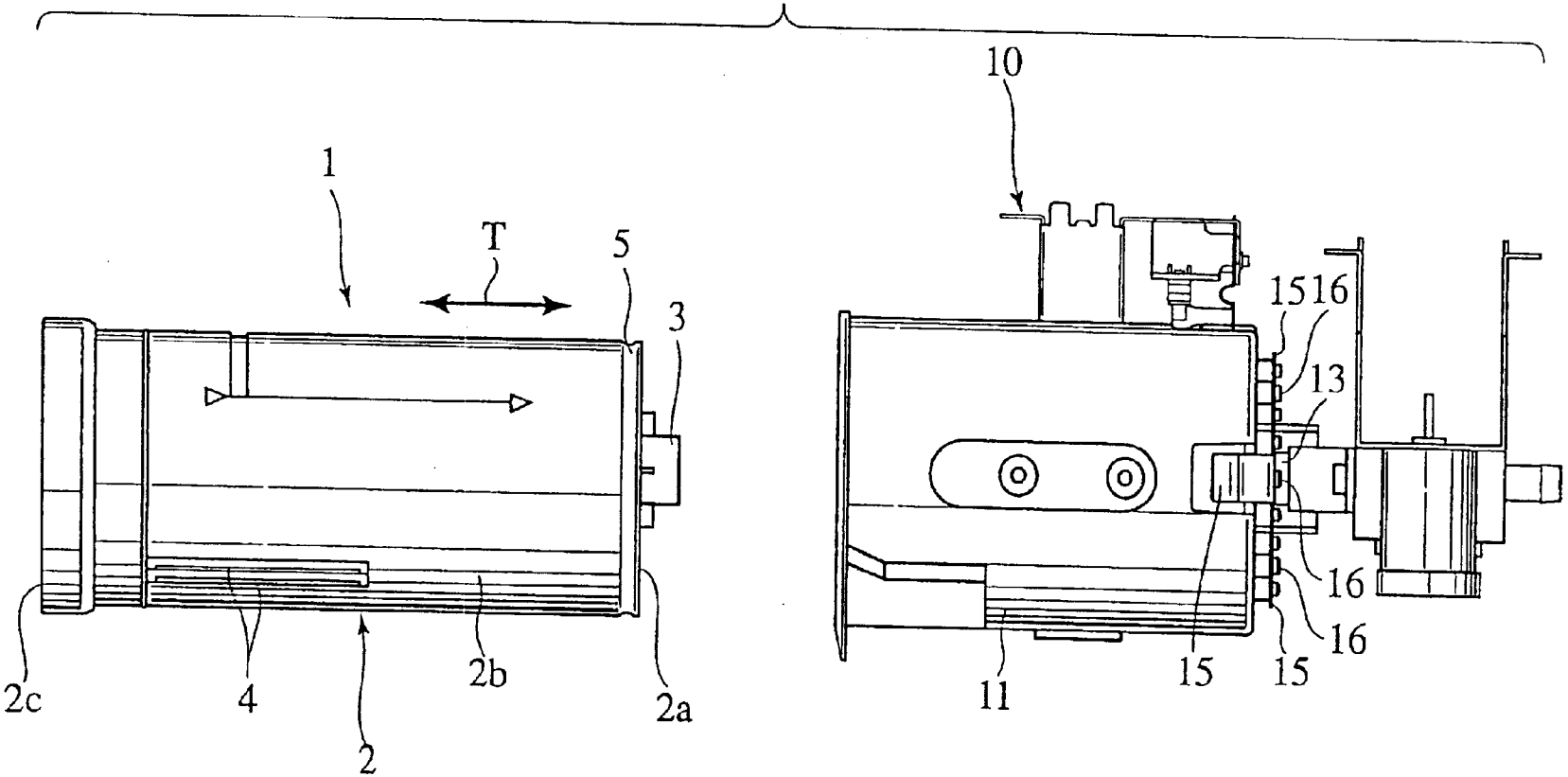
FIG. 8 shows the mode for carrying out the invention, and is a plan view of the ink bottle mounting apparatus before the ink bottle is inserted.
Figure 9:
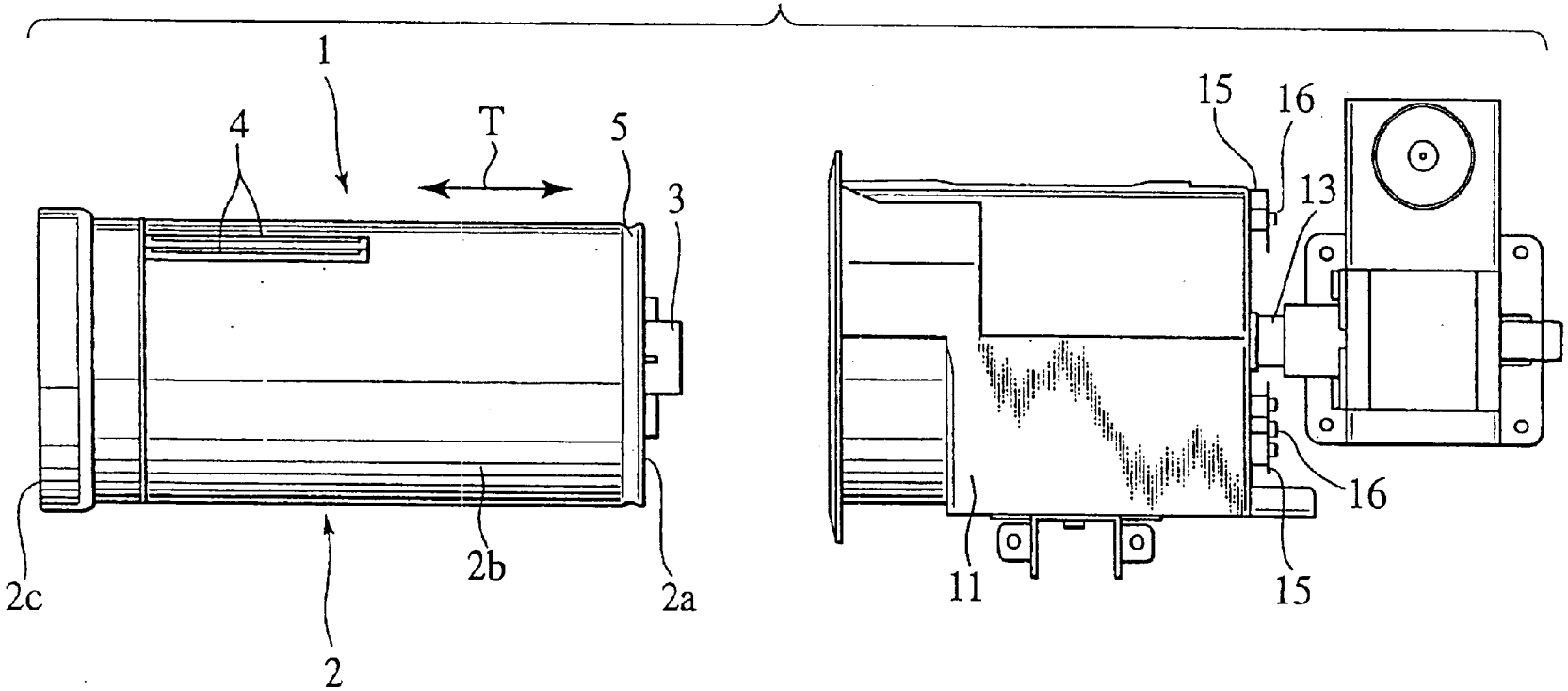
FIG. 9 shows the mode for carrying out the invention, and is a front view of the ink bottle mounting apparatus before the ink bottle is inserted.
Figure 10:
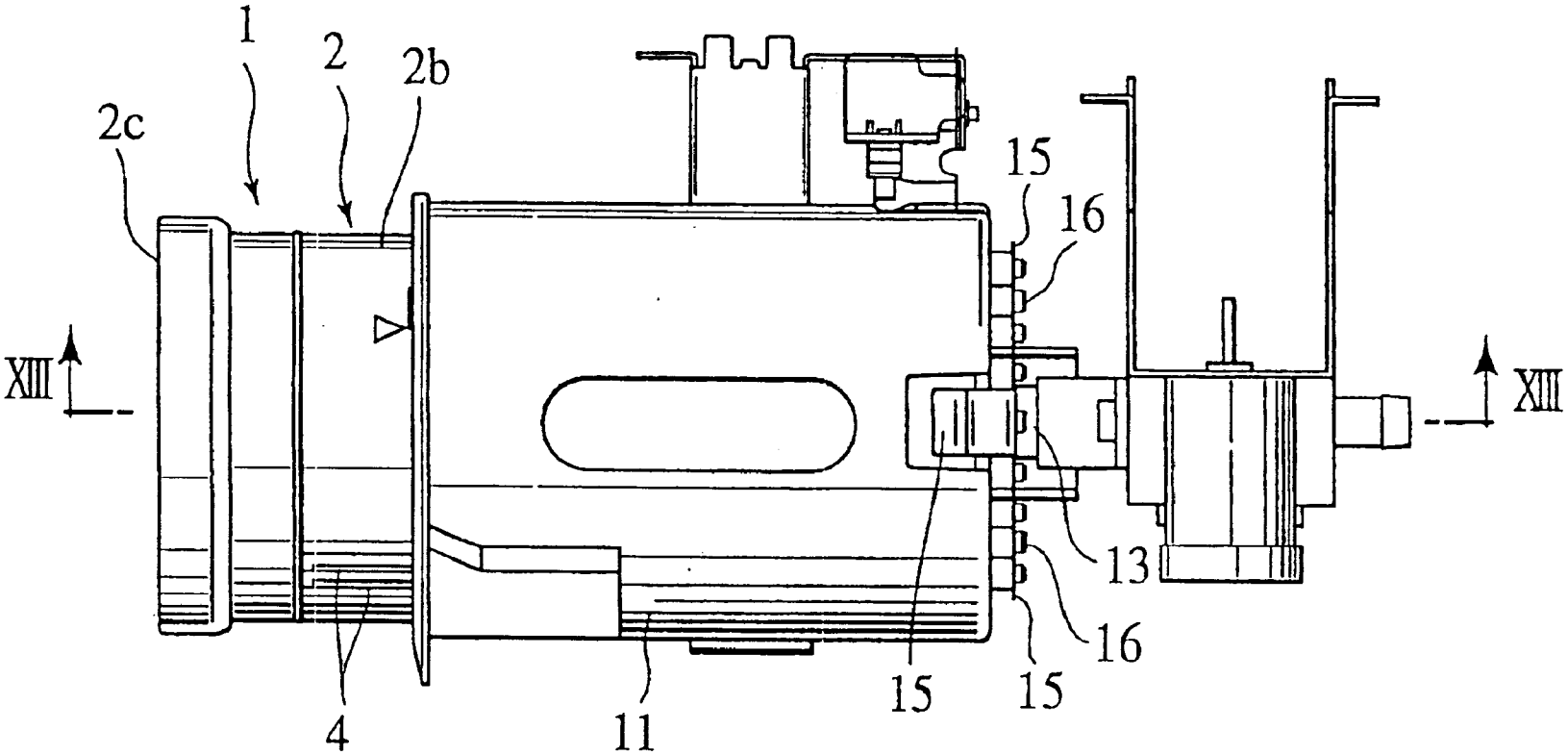
FIG. 10 shows the mode for carrying out the invention, and is a plan view of the ink bottle mounting apparatus to which the ink bottle is inserted.
Figure 11:
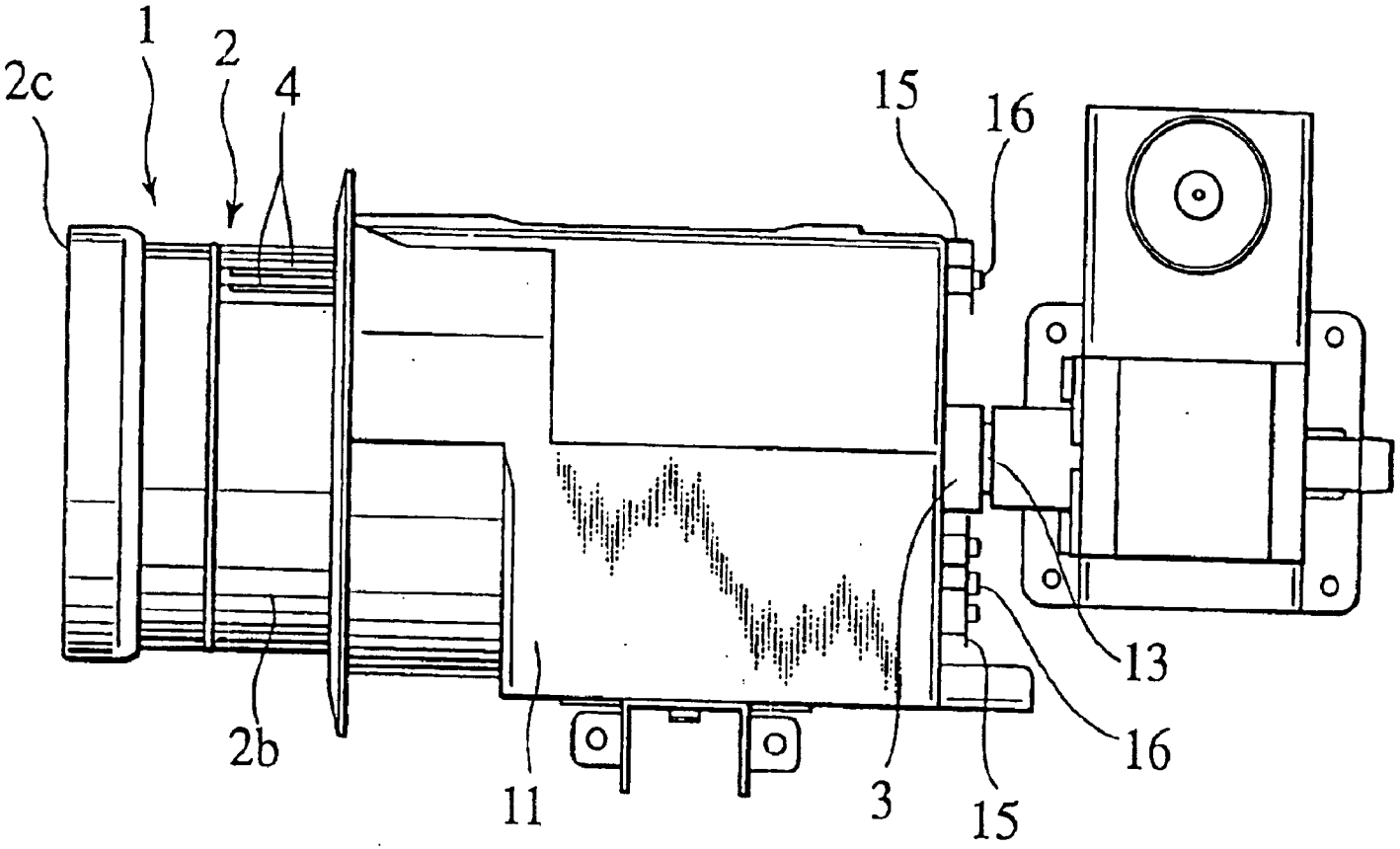
FIG. 11 shows the mode for carrying out the invention, and is a front view of the ink bottle mounting apparatus to which the ink bottle is inserted.
Figure 12:
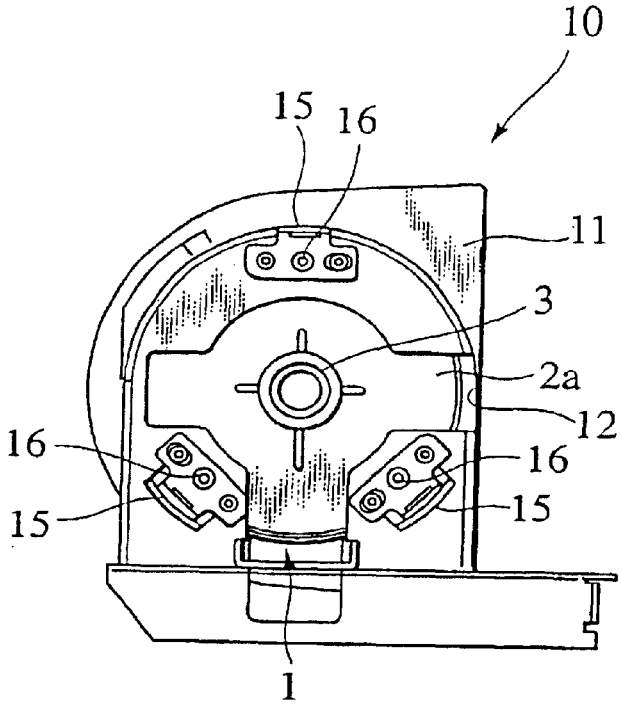
FIG. 12 shows the mode for carrying out the invention, and is a side view of the ink bottle mounting apparatus to which the ink bottle is inserted.
Figure 13:
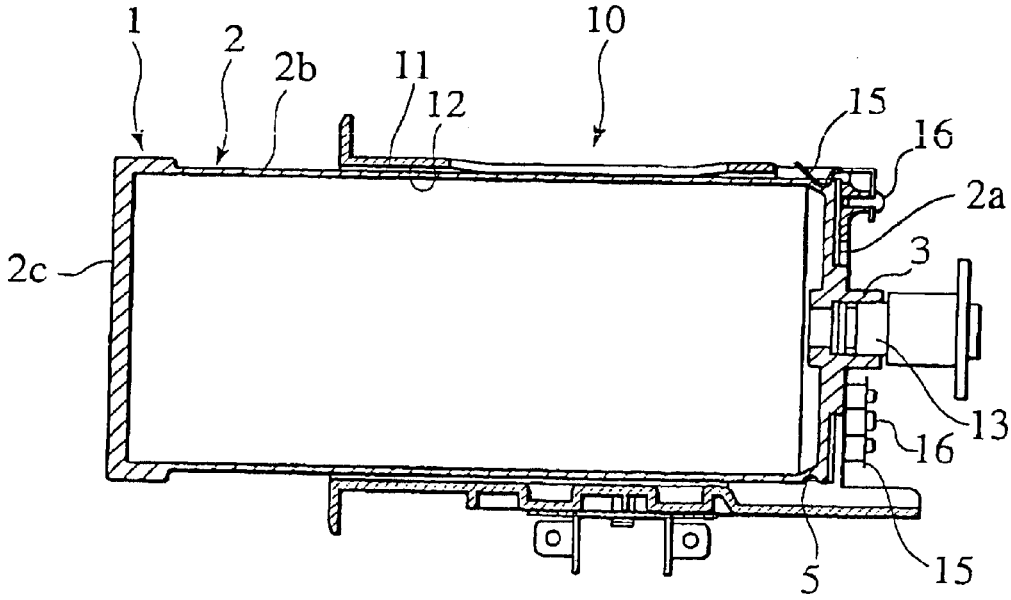
FIG. 13 shows the mode for carrying out the invention, and is a sectional view taken along a line XIII—XIII in FIG. 10.
Figure 14:
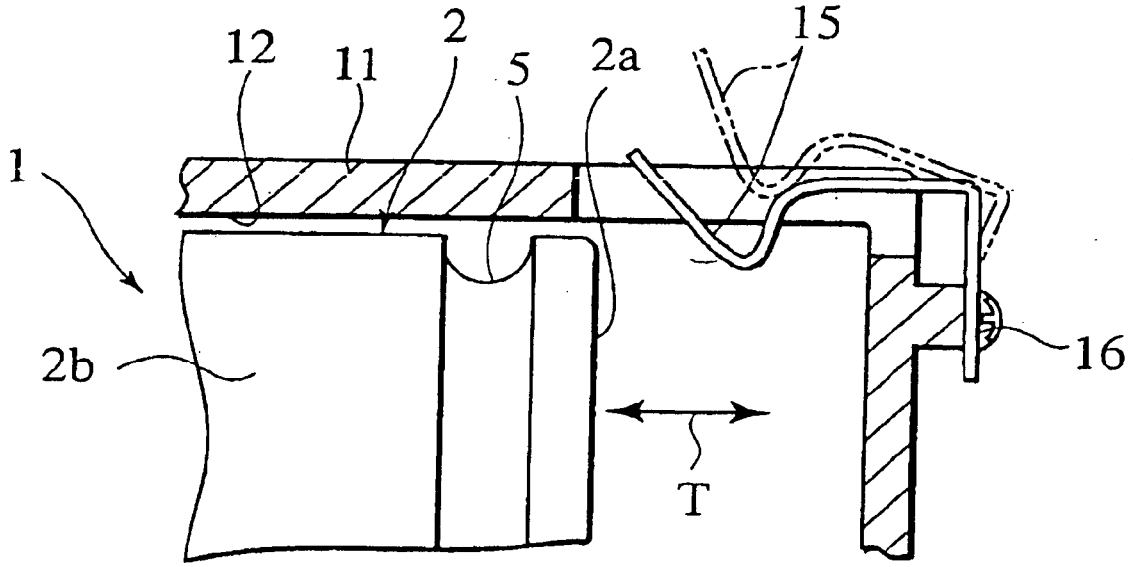
FIG. 14 is an enlarged sectional view showing a displacing state of a bottle lock member.

FIGS. 5 to 14 show the mode for carrying out the invention. FIG. 5 is a perspective view of an ink bottle mounting apparatus before an ink bottle is inserted, FIG. 6 is a perspective view of the ink bottle mounting apparatus to which the ink bottle is mounted, FIG. 7 is a perspective view, from a direction different from FIG. 6, of the ink bottle mounting apparatus to which the ink bottle is mounted, FIG. 8 is a plan view of the ink bottle mounting apparatus before the ink bottle is inserted, FIG. 9 is a front view of the ink bottle mounting apparatus before the ink bottle is inserted, FIG. 10 is a plan view of the ink bottle mounting apparatus to which the ink bottle is inserted, FIG. 11 is a front view of the ink bottle mounting apparatus to which the ink bottle is inserted, FIG. 12 is a rear view of the ink bottle mounting apparatus to which the ink bottle is inserted, FIG. 13 is a sectional view taken along a line XIII—XIII in FIG. 10, and FIG. 14 is an enlarged sectional view showing a displacing state of a bottle lock member.

[Ink Bottle]

An ink bottle of the present invention will first be explained with reference to FIGS. 5 to 14. The ink bottle 1 is made of synthetic resin, and has a cylindrical bottle body 2 in which ink is accommodated. An ink discharge port 3 projects from a central position of an insertion leading end surface 2*a* of the bottle body 2. In this mode for carrying out the invention, the insertion leading end surface 2*a* is a bottle fitting criterion surface. A positioning rib 4 extending in a bottle inserting/pulling out direction T is provided on a side peripheral surface 2*b* of the bottle body 2 on the side of an insertion rear end surface 2*b* of the bottle body 2 on the side of an insertion rear end surface 2*c*. The ink bottle 1 is inserted into a later-described bottle insertion chamber 12 only at a predetermined rotation position by this positioning rib 4. An annular groove (to-be locked portion) 5 is provided at a position in the vicinity of the insertion leading end surface 2*a* of the side peripheral surface 2*b* of the bottle body 2 along a circumferential direction. The groove 5 is provided over the entire circumference along the circumferential direction of the side peripheral surface 2*b*, and has a semi-arc cross section.

[Bottle Mounting Apparatus Body]

An ink bottle mounting apparatus 10 for mounting such an ink bottle 1 has a bottle mounting apparatus body 11. The bottle mounting apparatus body 11 is provided with the bottle insertion chamber 12. The bottle insertion chamber 12 has a diameter slightly larger than that of the bottle body 2, and one surface side of the bottle insertion chamber 12 has an opening 12*a* (shown in FIG. 7). The ink bottle 1 is inserted into the bottle insertion chamber 12 by the opening 12*a*, and the ink bottle 1 is pulled out from the bottle insertion chamber 12 utilizing a portion of the ink bottle 1 projected from the opening 12*a*. An ink suction port 13 is provided at a deepest side of the bottle insertion chamber 12. The ink discharge port 3 of the ink bottle 1 at the mounting position is connected to the ink suction port 13. The bottle mounting apparatus body 11 is provided with a positioning recess 14 opening at the bottle insertion chamber 12. Only when the positioning rib 4 of the ink bottle 1 is inserted into the positioning recess 14, the ink bottle 1 is allowed to be inserted into the bottle insertion chamber 12.

The bottle mounting apparatus body 11 is provided with three leaf springs 15 which are bottle lock members. The leaf springs 15 are provided at positions opposed to the groove 5 of the side peripheral surface 2*b* of the ink bottle 1 inserted into the bottle insertion chamber 12. Each of the leaf springs 15 is fixed at its base end to the bottle mounting apparatus body 11 by means of a screw 16, and a leading end of a free end of the leaf spring 15 is bent into L-shape, and projected into the bottle insertion chamber 12. The leading end of the leaf spring 15 can be displaced between a bottle lock position (solid line position in FIG. 14) where the leaf spring 15 enters into the groove 5 of the ink bottle 1 located at the mounting position and a bottle moving permissible position (phantom line position in FIG. 14) where the ink bottle 1 is allowed to move in are treating direction of the bottle insertion chamber 12 from the bottle lock position. If the leaf spring 15 receives a constant force or greater from the bottle inserting/pulling out direction T, the leaf spring 15 is displaced from the bottle lock position to the bottle moving permissible position by spring bending deformation due to this force, and if the force is not applied to the leaf spring 15, the spring 15 automatically returns to the bottle lock position by the spring bending returning deformation.

<Ink Bottle Replacing Operation>

In the above structure, a replacing operation of the ink bottle 1 will be explained. It is assumed that an old ink bottle 1 is mounted to the bottle insertion chamber 12, and as shown in FIG. 13 and the like, the leading end of the leaf springs 15 are inserted into the groove 5 of the ink bottle 1, and with this, the ink bottle 1 is locked to the mounting position.

An operator grasps a portion of the ink bottle 1 projecting from the bottle insertion chamber 12 with one hand, and a pulling force is applied in a direction to pull out the ink bottle 1 from the bottle insertion chamber 12. Then, the leaf springs 15 receive the pulling force of the ink bottle 1 and displaced from the bottle lock position to the bottle moving permissible position so that the ink bottle 1 is allowed to be pulled out, and the ink bottle 1 is pulled out from the bottle insertion chamber 12.

Next, the operator grasps a side peripheral surface 2*b* of a new ink bottle 1 on the side of the insertion rear end surface 2*c* with one hand, the positioning rib 4 of the ink bottle 1 is positioned to the positioning recess 14 of the bottle mounting apparatus body 11, and inserted into the bottle insertion chamber 12. As the insertion of the ink bottle 1 is proceeding, each of the leaf springs 15 abuts against the end of the insertion leading end surface 2*a* of the ink bottle 1. In this state, if the ink bottle 1 is further inserted, each of the leaf springs 15 receives the inserting force of the ink bottle 1 and displaced from the bottle lock position to the bottle moving permissible position, and the insertion of the ink bottle 1 is allowed. If the ink bottle 1 is inserted up to the mounting position, the groove 5 of the ink bottle 1 and the leading end of each leaf spring 15 are opposed, the leaf spring 15 does not receive the inserting force, the leaf spring 15 is displaced to the bottle lock position by the spring bending returning deformation, and the ink bottle 1 is locked.

The ink bottle 1 is locked in the mounting position, and the inserting operation and the pulling-out operation of the ink bottle 1 can be done by inserting and pulling out the ink bottle 1 with predetermined or greater inserting force and pulling out force. Therefore, the ink bottle 1 can be locked in the mounting position, and the ink bottle 1 can easily be replaced. If the related art and the present invention are compared with each other, the ink bottle 1 is locked in the mounting position both in the related art and the present invention, but in the related art, the ink bottle 1 can not be replaced without using both hands. Whereas, in the present invention, the ink bottle 1 can be replaced using only one hand.

In this mode for carrying out the invention, since the groove 5 of the ink bottle 1 is located on the side of the insertion leading end surface 2*a* of the ink bottle 1, even if the entire length of the ink bottle 1 is varied due to swelling of ink, a position of the groove 5 of the ink bottle 1 located in the mounting position is not varied almost at all. Therefore, even if the entire length is varied due to the swelling or the like of the ink bottle 1, the bottle can reliably be lock with a predetermined locking force.

In this mode for carrying out the invention, since the groove 5 of the ink bottle 1 is located on the side of the insertion leading end surface 2*a* of the ink bottle 1, even if the entire length of the ink bottle 1 is varied due to swelling of ink, a position of the groove 5 of the ink bottle 1 located in the mounting position is not varied almost at all. Therefore, even if the entire length is varied due to the swelling or the like of the ink bottle 1, the bottle can reliably be locked with a predetermined locking force.

<Another Mode for Carrying Out the Invention>

Figure 15:
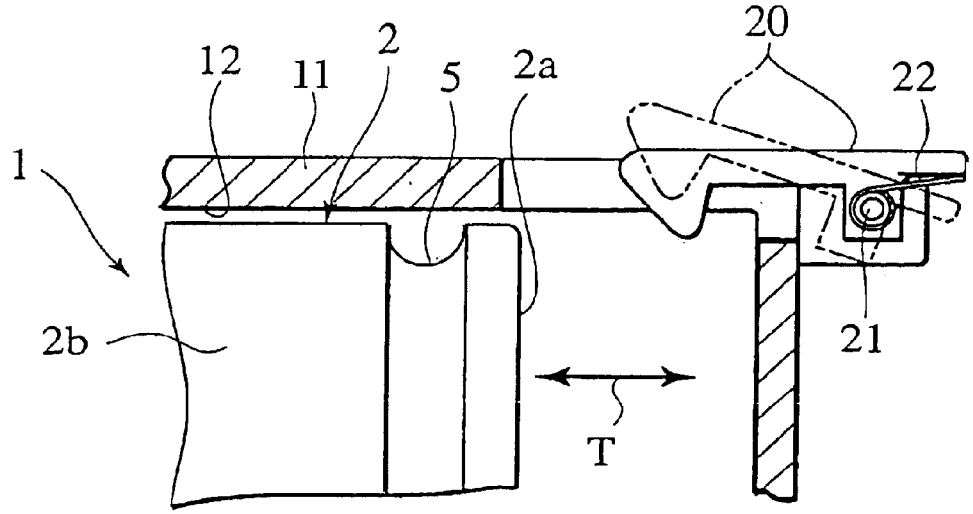
FIG. 15 shows a first embodiment of the mode for carrying out the invention, and is an enlarged sectional view showing the displacing state of the bottle lock member.

FIG. 15 shows a first embodiment of the bottle lock member and the to-be locked portion of the above mode for carrying out the invention, and is an enlarged sectional view showing a displacing state of the bottle lock member. As shown in FIG. 15, a bottle lock member 20 of the first embodiment is made of material having rigidity but having almost no spring force. A base end of the bottle lock member 20 is rotatably supported by a bottle mounting apparatus body 11 through a support shaft 21. By rotating and moving the bottle lock member 20 around the support shaft 21, the bottle lock member 20 can be displaced between the bottle lock position (solid line in FIG. 15) the bottle moving permissible position (phantom line in FIG. 15). A torsion spring 22 that is biasing means is disposed around the support shaft 21, and the bottle lock member 20 is biased toward the bottle lock position by a spring force of the torsion spring 22. A to-be locked portion provided on an insertion leading end of the bottle body 2 comprises a groove 5 having the same structure as that of the previous mode for carrying out the invention.

That is, if the bottle lock member 20 of the first embodiment received a constant or greater force from the bottle inserting/pulling out direction T, the bottle lock member 20 is displaced from the bottle lock position to the bottle moving permissible position against the spring force of the torsion spring 22 by this force, and if the bottle lock member 20 does not receive the force, the bottle lock member 20 is automatically returned to the bottle lock position by the spring force of the torsion spring 22.

Since the bottle lock member 20 of the first embodiment is moved between the bottle lock position and the bottle moving permissible position by the spring force of the torsion spring 22, the bottle lock member 20 is not deteriorated due to the repetition of displacement, and the bottle lock member 20 is excellent in durability.

Although the torsion spring 22 is used as the biasing means for biasing the bottle lock member 20 toward the bottle lock position in this first embodiment, biasing means other than a spring may also be used.

Figure 16:
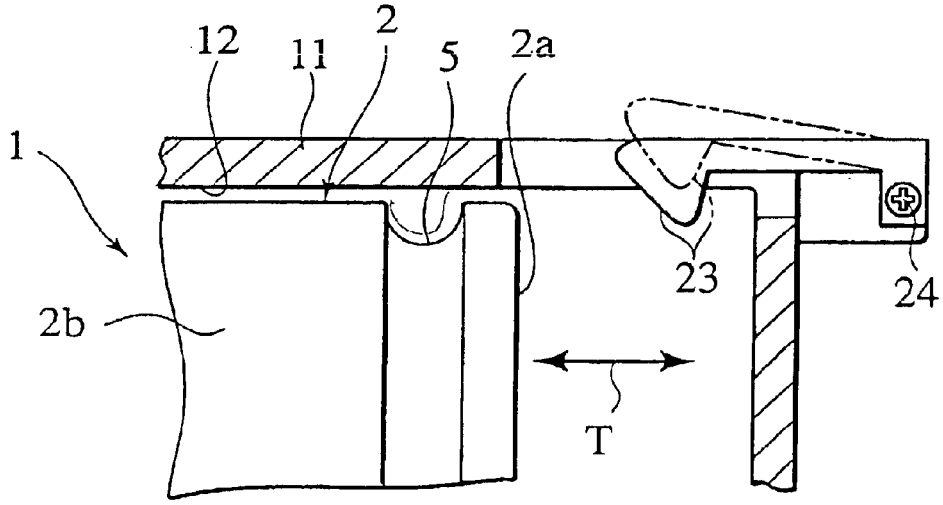
FIG. 16 shows a second embodiment of the mode for carrying out the invention, and is an enlarged sectional view showing the displacing state of the bottle lock member.

FIG. 16 shows a second embodiment of the bottle lock member and the to-be locked portion, and is an enlarged sectional view showing a displacing state of the bottle lock member. As shown in FIG. 16, a bottle lock member 23 is made of resiliently deformable synthetic resin. A base end of the bottle lock member 23 is fixed to a bottle mounting apparatus body 11 by means of a screw 24. A leading end of the bottle lock member 23 can be displaced between the bottle lock position (solid line in FIG. 16) the bottle moving permissible position (phantom line in FIG. 16). A to-be locked portion provided on an insertion leading end of the bottle body 2 comprises a groove 5 having the same structure as that of the previous mode for carrying out the invention.

That is, if the bottle lock member 23 of the second embodiment received a constant or greater force from the bottle inserting/pulling out direction T, the bottle lock member 23 is displaced from the bottle lock position to the bottle moving permissible position by a resilient deformation bending by the force, and the if force is not applied, the bottle lock member 23 is automatically returned to the bottle lock position by the resiliently deformation bending deformation.

Since the bottle lock member 23 of the second embodiment can be displaced between the bottle lock position and the bottle moving permissible position by the resilient deformation of the synthetic resin member, the bottle lock member 23 can be constructed simply.

Figure 17:
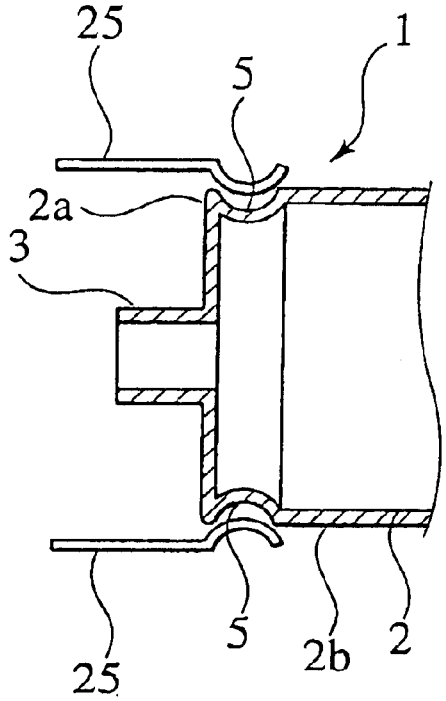
FIG. 17 shows a third embodiment of the mode for carrying out the invention, and is a sectional view showing a state in which the bottle lock member is engaged with a to-be locked portion.

FIG. 17 shows a third embodiment of the bottle lock member and the to-be locked portion, and is a sectional view showing a state in which the bottle lock member is engaged with the to-be locked portion. As shown in FIG. 17, a bottle lock member of the third embodiment is leaf springs 25 like the previous mode for carrying out the invention, and a free end of each of the leaf spring 25 is bent into an arc shape. A to-be locked portion provided on an insertion leading end of the bottle body 2 comprises a groove 5 having the same structure as that of the previous mode for carrying out the invention.

In this third embodiment, since both the leaf springs 25 and the groove 5 are formed into semi-arc surfaces, they can smoothly be engaged with and separated from each other.

Figure 18:
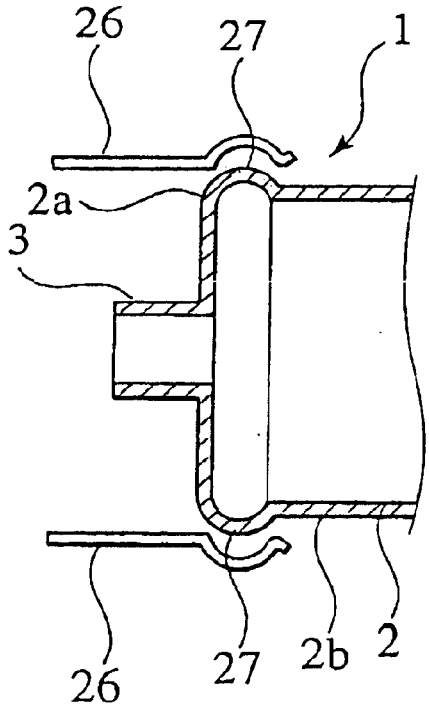
FIG. 18 shows a fourth embodiment of the mode for carrying out the invention, and is a sectional view showing a state in which the bottle lock member is engaged with the to-be locked portion.

FIG. 18 shows a fourth embodiment of the bottle lock member and the to-be locked portion, and is a sectional view showing a state in which the bottle lock member is engaged with the to-be locked portion. As shown in FIG. 18, the to-be locked portion provided on an insertion leading end of the bottle body 2 of the fourth embodiment comprises a projection 27 projecting from the side peripheral surface 2*b* in the form of an arc, and a free end of the bottle lock member comprises leaf springs 26 whose free ends are bent into an arc shape.

In this fourth embodiment also, since both the leaf springs 26 and the projection 27 are formed into semi-arc surfaces, they can smoothly be engaged with and separated from each other.

Figure 19:
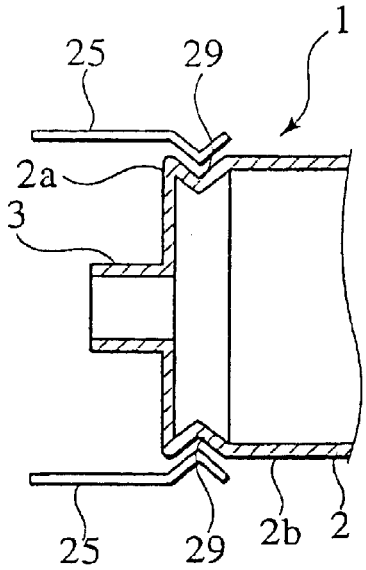
FIG. 19 shows a fifth embodiment of the mode for carrying out the invention, and is a sectional view showing a state in which the bottle lock member is engaged with the to-be locked portion.

FIG. 19 shows a fifth embodiment of the bottle lock member and the to-be locked portion, and is a sectional view showing a state in which the bottle lock member is engaged with the to-be locked portion. As shown in FIG. 19, this fifth embodiment is different from the third embodiment (shown in FIG. 17) only in that the leading ends of the leaf springs (bottle lock member) 25 and the groove (to-be locked portion) 29 are bent into L-shape.

Figure 20:
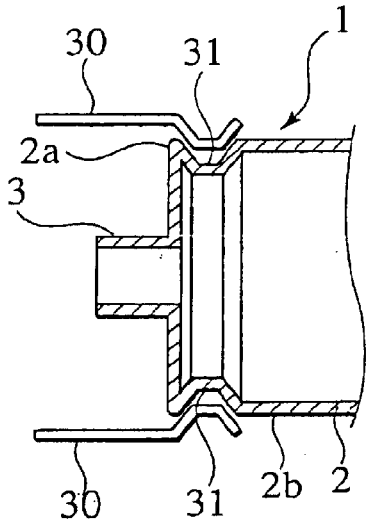
FIG. 20 shows a sixth embodiment of the mode for carrying out the invention, and is a sectional view showing a state in which the bottle lock member is engaged with the to-be locked portion.

FIG. 20 shows a sixth embodiment of the bottle lock member and the to-be locked portion, and is a sectional view showing a state in which the bottle lock member is engaged with the to-be locked portion. As shown in FIG. 20, this sixth embodiment is different from the third embodiment (shown in FIG. 17) only in that the leading ends of the leaf springs (bottle lock member) 30 and the groove (to-be locked portion) 31 are bent into trapezoidal shape.

Figure 21:
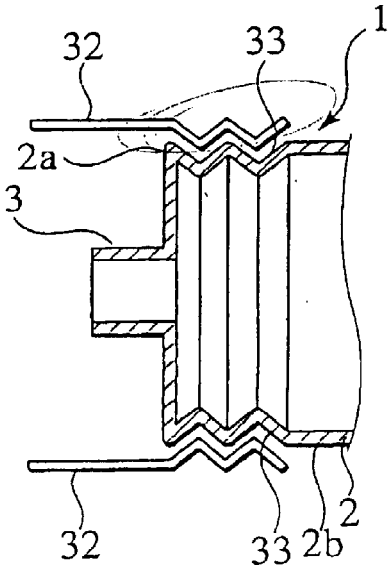
FIG. 21 shows a seventh embodiment of the mode for carrying out the invention, and is a sectional view showing a state in which the bottle lock member is engaged with the to-be locked portion.

FIG. 21 shows a seventh embodiment of the bottle lock member and the to-be locked portion, and is a sectional view showing a state in which the bottle lock member is engaged with the to-be locked portion. As shown in FIG. 21, this seventh embodiment is different from the third embodiment only in that the leading ends of the leaf springs (bottle lock member) 32 and the groove (to-be locked portion) 33 are bent into W-shape. As compared with the third embodiment, the bottle lock member is engaged with the to-be locked portion more strongly.

Figure 22:
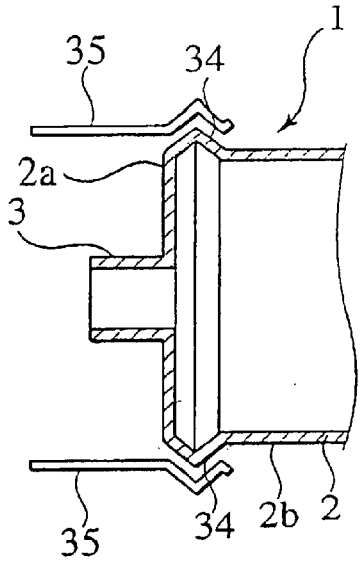
FIG. 22 shows an eighth embodiment of the mode for carrying out the invention, and is a sectional view showing a state in which the bottle lock member is engaged with the to-be locked portion.

FIG. 22 shows an eighth embodiment of the bottle lock member and the to-be locked portion, and is a sectional view showing a state in which the bottle lock member is engaged with the to-be locked portion. As shown in FIG. 22, the to-be locked portion of the bottle body 2 of this eighth embodiment comprises a projection 34 projecting into L-shape from the side peripheral surface 2*b*, and the bottle lock member comprises leaf springs 35 whose free ends are bent into L-shape in the opposite direction as the fifth embodiment (shown in FIG. 19).

Figure 23:
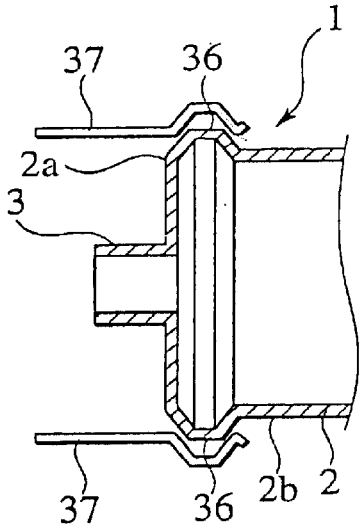
FIG. 23 shows a ninth embodiment of the mode for carrying out the invention, and is a sectional view showing a state in which the bottle lock member is engaged with the to-be locked portion.

FIG. 23 shows a ninth embodiment of the bottle lock member and the to-be locked portion, and is a sectional view showing a state in which the bottle lock member is engaged with the to-be locked portion. As shown in FIG. 23, the to-be locked portion of the bottle body 2 of this ninth embodiment comprises a projection 36 projecting trapezoidal shape from the side peripheral surface 2*b*, and the bottle lock member comprises leaf springs 39 whose free ends are bent into trapezoidal shape in the opposite direction as t he sixth embodiment (shown in FIG. 20).

Figure 24:
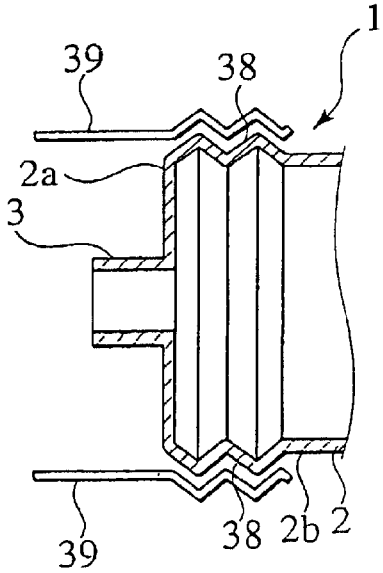
FIG. 24 shows a tenth embodiment of the mode for carrying out the invention, and is a sectional view showing a state in which the bottle lock member is engaged with the to-be locked portion.

FIG. 24 shows a tenth embodiment of the bottle lock member and the to-be locked portion, and is a sectional view showing a state in which the bottle lock member is engaged with the to-be locked portion. As shown in FIG. 24, the to-be locked portion of the bottle body 2 of this tenth embodiment comprises a projection 38 projecting w-shape from the side peripheral surface 2*b*, and the bottle lock member comprises leaf springs 37 whose free ends are bent into W-shape in the opposite direction as the seventh embodiment (shown in FIG. 21).

Figure 25:
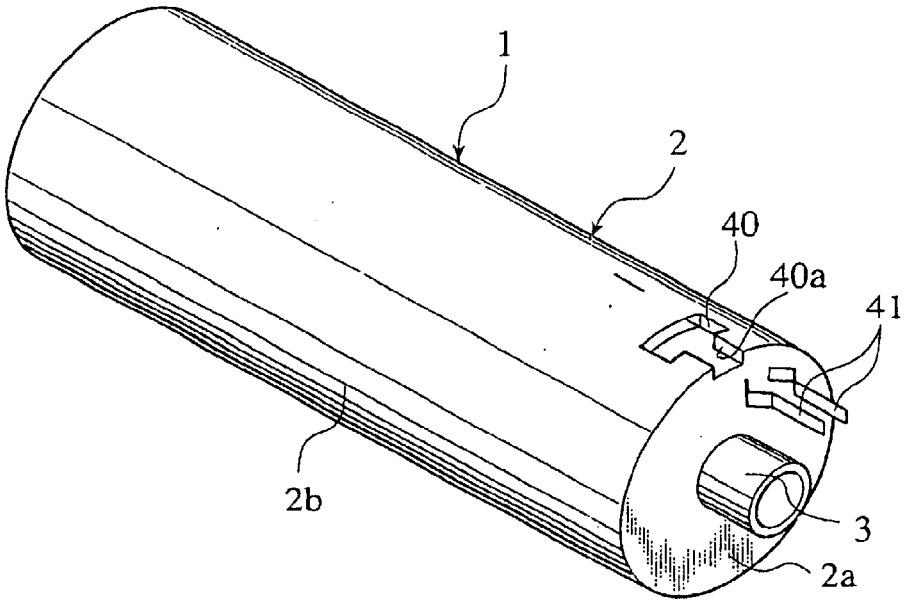
FIG. 25 shows an eleventh embodiment of the mode for carrying out the invention, and is a perspective view showing a state in which the bottle lock member is engaged with the to-be locked portion.

FIG. 25 shows an eleventh embodiment of the bottle lock member and the to-be locked portion, and is a perspective view showing a state before the bottle lock member is engaged with the to-be locked portion. As shown in FIG. 25, the to-be locked portion of the bottle body 20 of the eleventh embodiment is provided on a side peripheral surface 2*b* in the vicinity of the insertion leading end surface 2*a*, and the insertion leading end surface 2*a* is formed with a groove 40 having a narrow introducing guide groove 40*a* opened at the insertion leading end surface 2*a*. The bottle lock member comprises a pair of left and right spring members 41 and 41 which can be displaced by spring deformation in their approaching direction. A leading end of each of the spring members 41 is bent into L-shape.

If the ink bottle 1 is inserted into the bottle insertion chamber 12, the pair of spring members 41 and 41 are inserted into the introducing guide groove 40*a*. In this state, if the ink bottle 1 is further inserted, the pair of spring members 41 and 41 are spring-deformed in their approaching direction and, and insertion of the ink bottle 1 is allowed. When the ink bottle 1 is inserted up to the mounting position, the pair of spring members 41 and 41 are returned and deformed by spring force and engaged with the groove 40.

With this eleventh embodiment, external force in which the pair of spring members 41 and 41 deform the bottle body 2 is not generated at all, the ink bottle 1 can be designed without taking the deformation of the ink bottle 1 by the bottle lock member into account.

Figure 26:
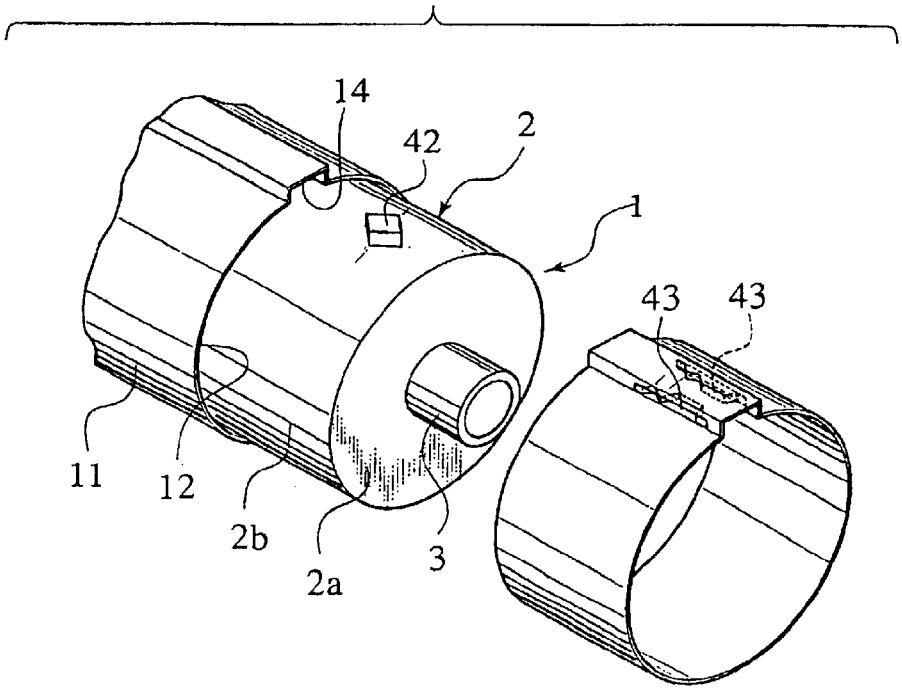
FIG. 26 shows a twelfth embodiment of the mode for carrying out the invention, and is a perspective view before the bottle lock member is engaged with the to-be locked portion.

FIG. 26 shows a twelfth embodiment of the bottle lock member and the to-be locked portion, and is a perspective view showing a state before the bottle lock member is engaged with the to-be locked portion. As shown in FIG. 26, a to-be locked portion of the bottle body 2 of the twelfth embodiment is provided on the side peripheral surface 2*b* in the vicinity of the insertion leading end surface 2*a*, and comprises a rhombus projection 42. The to-be locked member comprises a pair of left and right spring members 43 and 43 which can be displaced by spring deformation in their separating direction. A leading end of each of the spring members 43 is bent into L-shape.

If the ink bottle 1 is inserted into the bottle insertion chamber 12, the pair of spring members 43 and 43 abut against the rhombus projection 42. In this state, if the ink bottle 1 is further inserted, the pair of spring members 43 and 43 are spring-deformed in their separating direction and, and insertion of the ink bottle 1 is allowed. When the ink bottle 1 is inserted up to the mounting position, the pair of spring members 43 and 43 are engaged with the rhombus projection 42. The bottle mounting apparatus body 11 is provided with a positioning recess 14 opened at the bottle insertion chamber 12, and only when the rhombus protection 42 of the ink bottle 1 is inserted into the positioning recess 14, the ink bottle 1 is allowed to enter the bottle insertion chamber 12 that is, the rhombus projection 42 also functions for aligning the rotation position with respect to the ink insertion chamber 12.

With this twelfth embodiment, external force in which the pair of spring members 41 and 41 deform the bottle body 2 is not generated at all, the ink bottle 1 can be designed without taking the deformation of the ink bottle 1 by the bottle lock member into account.

Although the to-be locked portion is the groove or projection formed along the entire circumference of the side peripheral surface 2*b* of the bottle body 2 in the modes for carrying out the invention and the first to tenth embodiments, the groove or projection may be formed at corresponding positions of the bottle lock member. Further, in the modes for carrying out the invention and the first to tenth embodiments, the leaf springs 15, 25, 26, 28, 30, 32, 35, 37 and 39 which are bottle lock members are provided at three positions, but they may be formed on a single position, or two positions or four or more positions. It is preferable that the leaf springs are provided at a plurality of positions.

In the bottle lock member of the modes for carrying out the embodiments, spring force of the leaf spring 15, 25, 26, 28, 30, 32, 35, 37, 39, 41 and 43, spring force of the torsion spring 22, and resilient deformation of the synthetic resin member are utilized, but the structure of the bottle lock member is not limited only if the bottle lock member can be displaced between the bottle lock position and the bottle moving permissible position, and when the bottle lock member receives a constant or greater force from the bottle inserting/pulling out direction, the bottle lock member is displaced from the bottle lock position to the bottle moving permissible position, and if the force is not applied, the bottle lock member can automatically return to the bottle lock position.

The to-be locked portion of the ink bottle 1 of the modes for carrying out the embodiments is provided at a position near the insertion leading end surface (bottle fitting criteria surface) 2*a* of the side peripheral surface 2*b* of the bottle body 2, but the to-be locked portion may be provided at an arbitrary position (e.g., intermediate position) of the side peripheral surface 2*b* of the bottle body 2. If the position of the to-be locked portion is closer to the insertion leading end surface 2*a*, the to-be locked portion is closer to the ink discharge port 3, and since the positional variation due to the swelling of the ink bottle 1 becomes smaller and therefore, the ink bottle 1 can reliably be locked with a predetermined locking force.

What is claimed is:

1. An ink bottle mounting apparatus, which is used for a stencil printing machine, the apparatus comprising:

an ink bottle having a to-be locked portion formed on a side peripheral surface of the ink bottle; and a bottle mounting apparatus body having a bottle insertion chamber into which the ink bottle is inserted, wherein the bottle mounting apparatus body includes a bottle lock member, which is matingly engaged with the to-be locked portion, wherein the to-be locked portion further includes a guide face which puts the lock member and the to-be locked portion into engaged condition by guiding a portion of the lock member in the insertion direction of the ink bottle when the ink bottle is inserted into the chamber, and puts the lock member and the to-be locked portion into an unlocked condition by guiding the portion of the lock member in a removing direction of the ink bottle when the ink bottle is removed from the chamber, and wherein the guide face further includes first guide face which puts the lock member and the to-be locked portion into engaged condition by guiding the portion of the lock member in the insertion direction of the ink bottle when the ink bottle is inserted into the chamber, and second face being provided with the first face and which puts the lock member and the to-be locked portion into the unlocked condition by guiding the portion of the lock member in the removing direction of the ink bottle when the ink bottle is removed from the chamber.

2. An ink bottle mounting apparatus according to claim 1, wherein the bottle lock member is provided at a position opposed to the to-be locked portion formed on the ink bottle mounted to the bottle insertion chamber, the bottle lock member can be oriented in a bottle lock position where the bottle lock member engages the to-be locked portion of the ink bottle located at a mounting position and in a bottle moving permissible position where the ink bottle is allowed to move, and when the bottle lock member receives a constant or greater force from a bottle inserting/pulling out direction, the bottle lock member is displaced from the bottle lock position to the bottle moving permissible position by the force, and if the ink bottle is pulled out, the bottle lock member automatically returns to the position opposed to the to-be locked portion formed on the ink bottle mounted to the bottle insertion chamber.

3. An ink bottle mounting apparatus according to claim 1, wherein the bottle lock member engages the to-be locked portion located on an insertion leading end of the ink bottle.

4. An ink bottle mounting apparatus according to claim 1, wherein the bottle lock member comprises a leaf spring.

5. An ink bottle mounting apparatus according to claim 1, wherein the bottle lock member is biased toward a bottle lock position by a spring force of a spring.

6. An ink bottle mounting apparatus according to claim 1, wherein the bottle lock member is made of synthetic resin member that can be resiliently deformed.

7. An ink bottle mounting apparatus according to claim 1, wherein the bottle mounting apparatus body is provided with a positioning portion deciding the bottle mounting position.

8. An ink bottle mounting apparatus according to claim 1, wherein the bottle lock member is made of substantially rigid member having almost no spring force.

9. An ink bottle mounting apparatus according to claim 8, wherein the bottle lock member is biased toward the bottle lock position by a spring force of a torsion spring.

10. An ink bottle system including a bottle insertion chamber and an ink bottle that can be mounted therein by inserting a bottle body into the bottle insertion chamber of the ink bottle system, wherein the bottle body comprises a shaped to-be locked portion matingly engaged with a bottle lock member of the bottle mounting apparatus body at the mounting position of the side peripheral surface of the bottle body, wherein the to-be locked portion further includes a guide face which puts the lock member and the to-be locked portion into engaged condition by guiding one portion of the lock member in the insertion direction of the ink bottle when the ink bottle is inserted into the chamber, and puts the lock member and the to-be locked portion into an unlocked condition by guiding the portion of the lock member in a removing direction of the ink bottle when the ink bottle is removed from the chamber, and wherein the guide face further includes first guide face which puts the lock member and the to-be locked portion into engaged condition by guiding the portion of the lock member in the insertion direction of the ink bottle when the ink bottle is inserted into the chamber, and second face being provided with the first face and which outs the lock member and the to-be locked portion into the unlocked condition by guiding the portion of the lock member in the removing direction of the ink bottle when the ink bottle is removed from the chamber.

11. An ink bottle system according to claim 10, wherein the to-be locked portion is provided on an insertion leading end of the bottle body.

12. An ink bottle system according to claim 10, wherein the to-be locked portion is a groove that is recessed deeper than the side peripheral surface of the bottle body.

13. An ink bottle system according to claim 12, wherein the groove has a semi-arc cross section.

14. An ink bottle system according to claim 10, wherein the to-be locked portion is a projection projecting higher than the side peripheral surface of the bottle body.

15. An ink bottle system according to claim 10, wherein an insertion rear end surface of the side peripheral surface of the bottle body includes a positioning rib extending in a bottle inserting/pulling out direction.

* * * * *

UNITED STATES PATENT AND TRADEMARK OFFICE

CERTIFICATE OF CORRECTION

PATENT NO. : 6,871,588 B2
DATED : March 29, 2005
INVENTOR(S) : Sasaki et al.

It is certified that error appears in the above-identified patent and that said Letters Patent is hereby corrected as shown below:

Column 12,
Line 44, please delete “outs” and replace with -- puts --

Signed and Sealed this

Seventh Day of June, 2005

JON W. DUDAS
*Director of the United States Patent and Trademark Office*